US008616860B2

(12) United States Patent
Wollitz

(10) Patent No.: US 8,616,860 B2
(45) Date of Patent: Dec. 31, 2013

(54) SYSTEM AND METHOD FOR REDUCING COMPRESSOR NOISE

(75) Inventor: John Kenneth Wollitz, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 320 days.

(21) Appl. No.: 12/719,250

(22) Filed: Mar. 8, 2010

(65) Prior Publication Data

US 2011/0217185 A1 Sep. 8, 2011

(51) Int. Cl.
*F04B 17/03* (2006.01)
*A47B 81/06* (2006.01)
*F16F 7/00* (2006.01)

(52) U.S. Cl.
USPC ..... 417/363; 181/198; 181/207

(58) Field of Classification Search
USPC ..... 417/363; 181/198, 200, 202, 207, 209
See application file for complete search history.

(56) References Cited

U.S. PATENT DOCUMENTS

| | | | | |
|---|---|---|---|---|
| 756,203 | A | | 4/1904 | Barthel |
| 1,030,933 | A | | 7/1912 | Smith |
| 2,130,276 | A | | 9/1938 | Hornaday |
| 2,297,220 | A | | 9/1942 | Hintze |
| 3,420,553 | A | * | 1/1969 | Poxon et al. ..... 285/49 |
| 3,848,931 | A | * | 11/1974 | Swisher ..... 299/100 |
| 3,937,598 | A | | 2/1976 | Stannow et al. |
| 4,347,043 | A | | 8/1982 | Morris |
| 4,384,635 | A | | 5/1983 | Lowery |
| 4,676,473 | A | | 6/1987 | Giles |
| 4,729,723 | A | | 3/1988 | Outzen |
| 4,958,990 | A | | 9/1990 | Gordon et al. |
| 4,982,812 | A | | 1/1991 | Hwang |
| 4,991,406 | A | * | 2/1991 | Fujii et al. ..... 62/296 |
| 5,151,018 | A | | 9/1992 | Clendenin et al. |
| 5,158,514 | A | | 10/1992 | Braga |
| 5,252,038 | A | | 10/1993 | Mangyo et al. |
| 5,272,285 | A | * | 12/1993 | Miller ..... 181/202 |
| 5,274,200 | A | * | 12/1993 | Das et al. ..... 181/202 |
| 5,281,105 | A | | 1/1994 | Osaka et al. |
| 5,487,648 | A | | 1/1996 | Alfano et al. |
| 5,588,810 | A | | 12/1996 | DiFlora et al. |
| 5,997,258 | A | | 12/1999 | Sawyer, III et al. |
| 6,033,756 | A | * | 3/2000 | Handscomb ..... 428/138 |
| 6,035,963 | A | | 3/2000 | Wollitz |
| 6,132,183 | A | | 10/2000 | Li et al. |
| 6,450,150 | B1 | * | 9/2002 | Sanden et al. ..... 123/509 |

(Continued)

OTHER PUBLICATIONS

Foreign Communication from a Counter-Part Application, Chinese Office Action dated May 6, 2013, Chinese Application No. 201110063164.5, 19 pgs.

(Continued)

*Primary Examiner* — Charles Freay
(74) *Attorney, Agent, or Firm* — Conley Rose, P.C.; J. Robert Brown, Jr.; Alan Dawson Lightfoot

(57) ABSTRACT

A noise reduced compressor has a body, an energy dissipation element, and a structural element configured to retain the energy dissipation element relative to the body. A noise reducer for an HVAC system compressor has an energy dissipation element and a structural element connected to the energy dissipation element. A method of reducing compressor noise includes disposing an energy dissipation element between a body of the compressor and a structural element and compressing the energy dissipation element against between the body of the compressor using the structural element.

13 Claims, 7 Drawing Sheets

(56) References Cited

U.S. PATENT DOCUMENTS

| | | | | |
|---|---|---|---|---|
| 6,494,690 | B2 | 12/2002 | Seo | |
| 6,669,452 | B2 * | 12/2003 | Ogawa et al. | 417/360 |
| 6,932,190 | B2 * | 8/2005 | Sishtla | 181/290 |
| 7,179,061 | B2 | 2/2007 | Horton et al. | |
| 7,278,834 | B2 * | 10/2007 | Herrick et al. | 417/363 |
| 7,357,219 | B2 * | 4/2008 | Mafi et al. | 181/202 |
| 7,398,855 | B2 | 7/2008 | Seel | |
| 2009/0162226 | A1 * | 6/2009 | Campbell | 417/423.14 |

OTHER PUBLICATIONS

Foreign Communication from a Counter-Part Application, Canadian Office Action dated May 27, 2013, Canadian Application No. 2,733,678, 3 pgs.

* cited by examiner

SYSTEM AND METHOD FOR REDUCING COMPRESSOR NOISE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise one or more compressors for compressing and/or pumping refrigerants. In some HVAC systems, the one or more compressors may be disposed within a so-called "condensing unit" that may comprise the one or more compressors, a heat exchanger (sometimes referred to as a "condenser coil"), and a fan assembly configured to selectively force air into contact with the heat exchanger. In some installations of HVAC systems, a condensing unit may be located exterior to a building or space to be conditioned by the HVAC system. It is not uncommon for a condensing unit to be located substantially adjacent an exterior wall of such a building and for the exterior wall to generally delimit a living space within the building. Accordingly, noise generated by the condensing unit as a whole may undesirably be perceived by persons within the building, outdoors, and/or in other buildings.

SUMMARY OF THE DISCLOSURE

In some embodiments of the disclosure, a noise reduced compressor is provided. The noise reduced compressor may comprise a body, an energy dissipation element, and a structural element configured to retain the energy dissipation element relative to the body.

In other embodiments of the disclosure, a noise reducer for an HVAC system compressor is provided. The noise reducer may comprise an energy dissipation element and a structural element connected to the energy dissipation element.

In still other embodiments of the disclosure, a method of reducing compressor noise is provided. The method of reducing compressor noise may comprise disposing an energy dissipation element between a body of the compressor and a structural element and compressing the energy dissipation element against the body of the compressor using the structural element.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
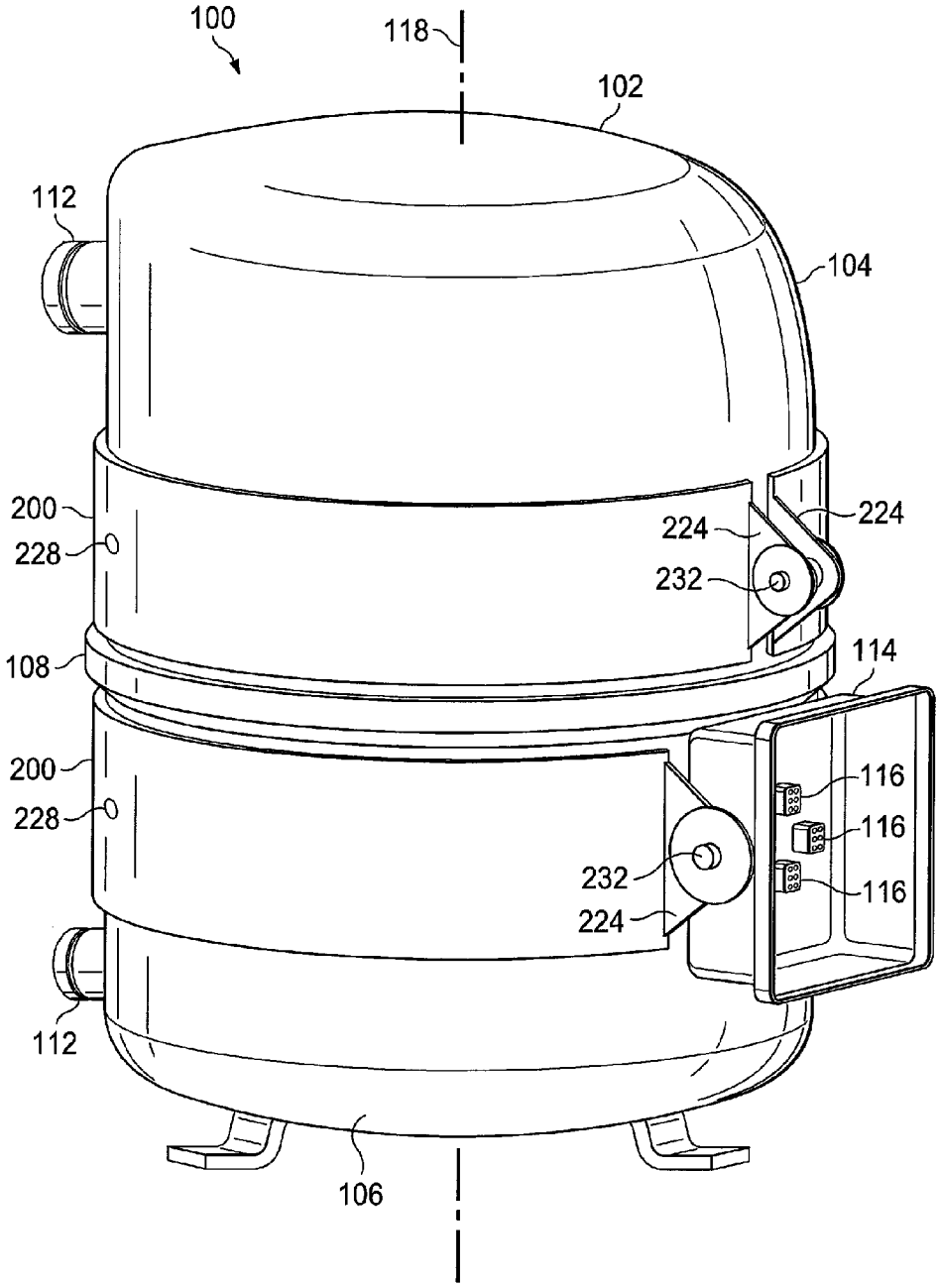
FIG. 1 is an orthogonal side view of a noise reduced compressor according to an embodiment of the disclosure.
Figure 2:
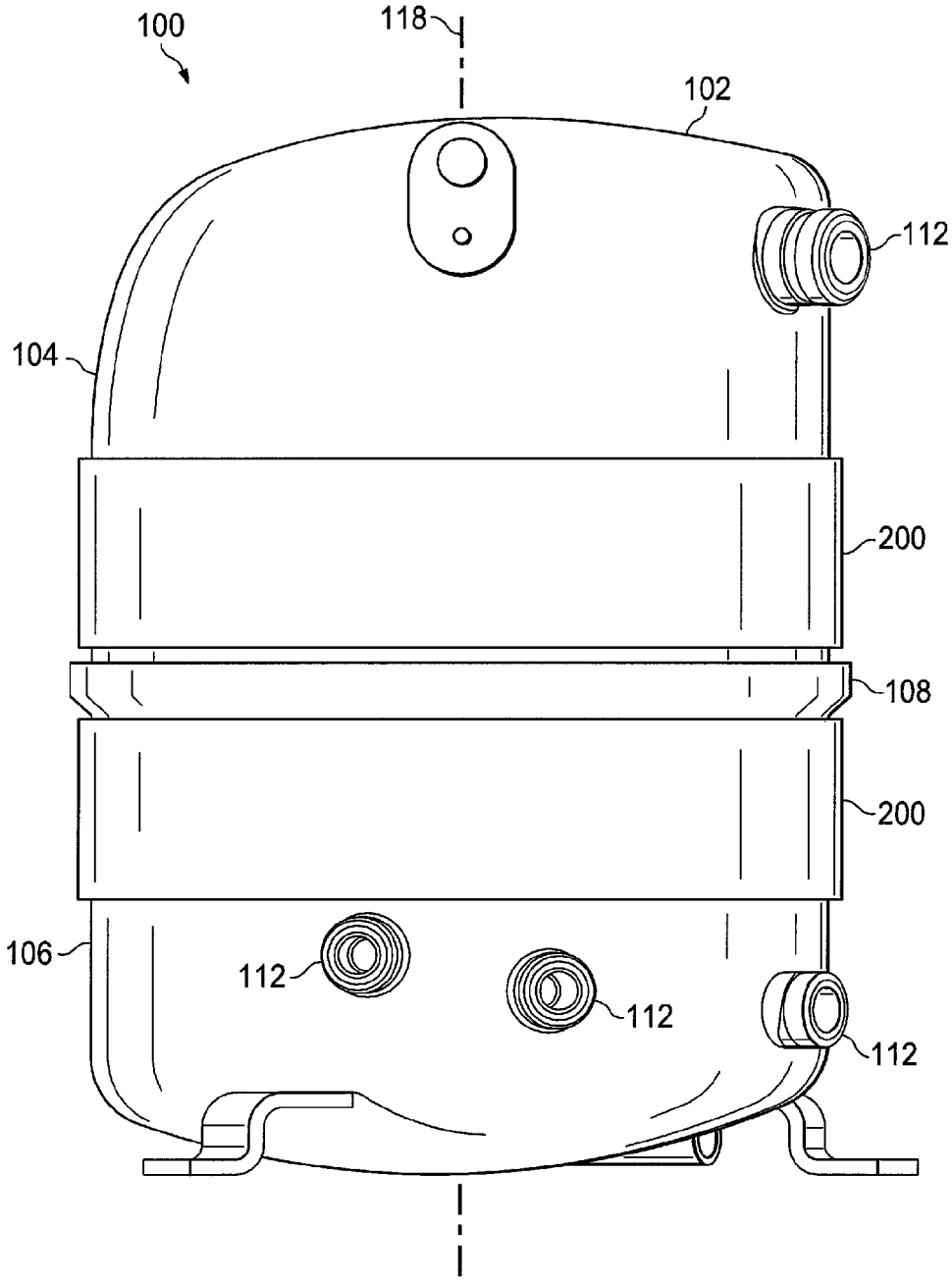
FIG. 2 is another orthogonal side view of the noise reduced compressor of FIG. 1.

In some HVAC systems, a primary source of noise generated by a condensing unit may be attributable to the one or more compressors of the condensing unit. As such, some condensing units and/or compressors have been outfitted with and/or associated with noise reducing covers and/or encasements. For example, some HVAC systems have been provided with canister-like covers that substantially loosely envelop one or more compressors of a condensing unit. While the covers may provide a reduction in noise transmitted from the compressor and/or condensing unit, the use of covers may introduce other undesirable effects. For example, use of the above-described cover may undesirably require an increased overall volume of the condensing unit to accommodate the cover within the condensing unit. Further, when a cover is disposed about a compressor, the cover may occupy space between the covered compressor and a condenser coil that, but for the presence of the cover, would have been available as a desirable flow path for air to pass as air is selectively caused to contact a condenser coil. As such, use of a cover may impede desirable heat exchange between the condensing coil and the air. Still further, a cover that substantially loosely envelops a compressor may limit and/or complicate service access to the covered compressor. Additionally, the amount of material required to produce a cover that substantially envelops a compressor may be substantial and/or cost prohibitive for some applications.

There is a need for improved systems and methods of reducing HVAC system noise, and in particular HVAC system noise attributable to operation of a compressor. Accordingly, the present disclosure provides systems and methods for reducing HVAC system noise that is attributable to a compressor. The systems and methods of the present disclosure provide noise reduction by transferring vibratory energy of the compressor into one or more energy dissipation elements of a noise reducer. In some embodiments, at least a portion of the noise reducer may be carried by the compressor from which the vibratory energy emanates. In some embodiments, the noise reducer may be configured to substantially lie within one or more dimensional footprints of a compressor to which the noise reducer is attached.

FIGS. 1-4 show a noise reduced compressor 100 according to an embodiment of this disclosure. The compressor 100 comprises a hermetically sealed body 102. The body 102 comprises an upper shell 104 and a lower shell 106. In this embodiment, the upper shell 104 and the lower shell 106 may be welded together to form a hermetic joint 108 that generally extends substantially circumferentially about an outer periphery of the body 102. In some embodiments, a lower portion of the upper shell 104 may be received into an upper portion of the lower shell 106 to form the body 102 prior to performing the above-described welding. After the lower portion of the upper shell 104 is received by the upper portion of the lower shell 106, the lower shell 106 may be welded to the upper shell 104, in some embodiments, resulting in a substantially circumferential weld bead along the hermetic joint 108. The hermetic joint 108 may be described as having a thickness 110 that may contribute to a larger outer periphery of the compressor 100 as compared to a substantially similar but alternative embodiment of a body 102 that does not comprise the thick hermetic joint 108. The compressor 100 further comprises a plurality of refrigerant tubes 112 that may serve to allow ingress and/or egress of refrigerant, oils, and/or other matter relative to an interior of the sealed body 102. The compressor 100 further comprises a terminal box 114 that generally houses electrical terminals 116 that may provide an electrical connection to an electrical motor housed within the body 102.

In this embodiment, the compressor 100 may have a significant vibratory mode related to the upper shell 104 and a different significant vibratory mode related to the lower shell 106. The vibratory modes of the upper shell 104 and the lower shell 106 may increase in amplitude as mechanical oscillation of the body 102 occurs at and/or near one or more resonant natural frequencies (and/or one or more harmonics thereof) of the body 102 as a whole, the upper shell 104, and/or the lower shell 106. In some embodiments, the various vibratory modes of the compressor 100 may result in the walls of the body 102 elastically deforming inward and outward in an alternating manner at various frequencies. It will be appreciated that during operation of the compressor 100, a plurality of vibratory modes may occur simultaneously and may be distinguished from each other by the frequency at which the vibration of the modes occur. In some embodiments, the above-described vibratory modes may be identified experimentally or analytically, such as through finite element analysis and/or other systems analysis, as having one or more fields of relatively higher amplitude vibratory vectors along the body 102.

In some embodiments of the compressor 100, vibratory vectors of the upper shell 104 may have concentrations of greater amplitude along the length of a vertical distance above the hermetic joint 108. The higher amplitude vibratory vectors of the upper shell 104 may be identified as primarily comprising alternating directionality that alternates between being directed generally radially inward and being directed generally radially outward with respect to a hypothetical central lengthwise axis 118 of the body 102.

Similarly, in some embodiments of the compressor 100, vibratory vectors of the lower shell 106 may have concentrations of greater amplitude along the length of a vertical distance below the hermetic joint 108. The higher amplitude vibratory vectors of the lower shell 106 may be identified as primarily comprising alternating directionality that alternates between being directed generally radially inward and being directed generally radially outward with respect to the hypothetical central lengthwise axis 118 of the body 102.

In some embodiments of the compressor 100 where the higher amplitude vibratory vectors primarily comprise vibrations with a significant component oriented substantially normal to the surfaces of the generally vertical cylindrical portions of the upper shell 104 and the lower shell 106, noise reducers 200 may be utilized to reduce noise that results from the above-described vibration at resonant natural frequencies. In particular, noise reducers 200 may be used to provide constrained layer damping effects and/or other mechanisms of dissipating energy transferred to the noise reducers 200 in response to the above-described vibratory oscillations of the body 102. Accordingly, as power and energy are transferred into the noise reducers 200 (and in some embodiments used to perform mechanical work), the power and energy may ultimately be transferred to the environment as heat energy. In some embodiments, the noise reducers 200 serve to divert energy away from processes that would contribute to production of undesirable noise. In some embodiments, the noise reducers 200 convert energy to mechanical work that generates heat rather than allow the above-described production of noise. The structure and functionality of the noise reducers 200 are described below in greater detail along with the methods of applying the noise reducers 200 to the body 102.

Referring now to FIGS. 5-9, an embodiment of a noise reducer 200 is shown in greater detail. The noise reducer 200 generally comprises an energy dissipation element (hereinafter referred to as an "EDE") 202 and a structural element 204. In some embodiments, the EDE 202 comprises a generally flexible rectangular sheet of rubber. The EDE 202 may comprise an inner side 206, an outer side 208, an upper side 210, a lower side 212, and ends 214. In some embodiments, the rubber of the EDE 202 may comprise a hardness of about 30 durometer to about 120 durometer, alternatively about 45 durometer to about 90 durometer, alternatively about 60 durometer. In some embodiments, the rubber may be an ethylene propylene diene Monomer (M-class) rubber. Of course, in other embodiments other compressible and/or incompressible materials may be used and those materials may have other hardnesses and/or substantially variable hardnesses. In some embodiments, a thickness of the EDE 202 as generally measured from the inner side 206 to the outer side 208 may be about 0.05 inches to about 0.5 inches, alternatively about 0.1 inches to about 0.2 inches, alternatively about 0.11 inches to about 0.14 inches. In some embodiments a length of the EDE 202 may be such that the EDE 202 may be substantially wrapped around an exterior circumference of the body 102. Of course, in other embodiments, a length of the EDE 202 may be significantly shorter than or longer than a circumference of the body 102. In an embodiment where the EDE 202 is significantly longer than a circumference of the body 102, the EDE 202 may be folded over itself into multiple layers. In embodiments where the EDE 202 is significantly shorter than a circumference of the body 102, one or more EDEs 202 may be utilized in a single noise reducer 200.

In some embodiments, the structural element 204 may comprise a non-galvanized 24-gauge substantially rectangular steel sheet. The structural element 204 may generally comprise an inner side 216, an outer side 218, an upper side 220, a lower side 222, and end tabs 224. The tabs 224 may extend away from the outer side 218 in a generally orthogonal manner. Alternatively, the tabs 224 may extend away from the outer side 218 at an angle of about 45 degrees to about 135 degrees each. Still alternatively, the tabs 224 may be angled away from a remainder of the structural element 204 by about 94 degrees, at different angles, and/or at any other suitable angles and/or combination of angles that allow application of the structural element 204 to the body 102 as described below. Further, in some embodiments, the overall length of the structural element 204 may be substantially similar to the length of the EDE 202, the overall length of the structural element 204 may be longer than the length of the EDE 202, and/or the overall length of the structural element 204 may be shorter than the length of the EDE 202. Further, in some embodiments, the structural element 204 may be surface treated to comprise an iron phosphate weight of between about 20 milligrams per square foot to about 60 milligrams per square foot and may thereafter be painted to comprise a high gloss powder baked finish.

In some embodiments, assembly of a noise reducer 200 may comprise joining the EDE 202 to the structural element 204. In some embodiments, each of the EDE 202 and the structural element 204 may comprise apertures 226 that accept fasteners 228 therethrough to connect the EDE 202 to the structural element 204. In some embodiments, two apertures 226 may be provided substantially centered along a width of the EDE 202 and the structural element 204 and substantially evenly distributed along the lengths of the EDE 202 and the structural element 204. In some embodiments, the fasteners 228 may each comprise a nylon split rivet. As such, assembly of the noise reducer 200 may be accomplished by coaxially aligning the two sets of apertures 226 of the EDE 202 and the structural element 204, bringing the inner side 216 of the structural element 204 into abutment with the outer side 208 of the EDE 202, and inserting fasteners 228 through the apertures 226 to keep the above-described orientation. In alternative embodiments, the EDE 202 may be spatially retained relative to the structural element 204 in any other suitable manner, including, but not limited to the use of adhesives that may be disposed between the EDE 202 and the structural element 204.

An assembled noise reducer 200 may be applied to a body 102 to produce a noise reduced compressor 100. In some embodiments, a noise reducer 200 may naturally resiliently hold a substantially flat shape prior to being applied to a body 102. As such, installing a substantially flat noise reducer 200 that is flexible along a length of the noise reducer 200 may comprise first having constructed a noise reducer 200 that is suitably configured to wrap around a substantial portion of an exterior of the body 102. Once the noise reducer 200 is wrapped around the body 102, in some embodiments, the tabs 224 may be offset from each other by a tab offset distance 230. Subsequently, a connector 232 may be used to draw the offset tabs 224 nearer to each other and/or to otherwise tighten the noise reducer 200 circumferentially around the body 102. In some embodiments, the tabs 224 may comprise tab connector features 234 that may cooperate with one or more connectors 232 to cause the structural element 204 to press the EDE 202 against the body 102 with an increased force. In some embodiments, the connector 232 may comprise a system of threaded bolts, washers, and/or nuts for progressively reducing the tab offset distance 230. In some embodiments the tab connector features 234 may comprise apertures formed in the tabs 224 to allow passage of a bolt therethrough. Alternatively, connectors 232 may comprise any other suitable combination of compression and/or tension devices and the tab connector features 234 may comprise any other feature suitable for allowing a connector 232 to draw tabs 224 closer to each other. In alternative embodiments, the EDE 202 may be pressed against the body 102 using any other suitable system and/or device. Further, in some embodiments, one or more additional components may be at least partially received between the EDE 202 and the body 102.

It is shown in FIGS. 1-4 that multiple noise reducers 200 may be applied to a single body 102. As shown, an upper noise reducer 200 is configured as described in detail above. However, a lower noise reducer 200 is configured to be shorter than the upper noise reducer 200. Further, instead of passing a single bolt through the tab connector features 234 of each tab 224, each tab 224 of the lower noise reducer 200 is associated with separate connectors 232, the connectors 232 being offset from each other and, in some embodiments, associated with the terminal box 114. As such, the lower noise reducer 200 may be applied in a manner similar to the upper noise reducer 200, but instead of using a single connector 232 to draw the tabs 224 toward each other, multiple connectors 232 that are anchored to a portion of the compressor 100 are used to provide the desired application of force.

Figure 3:
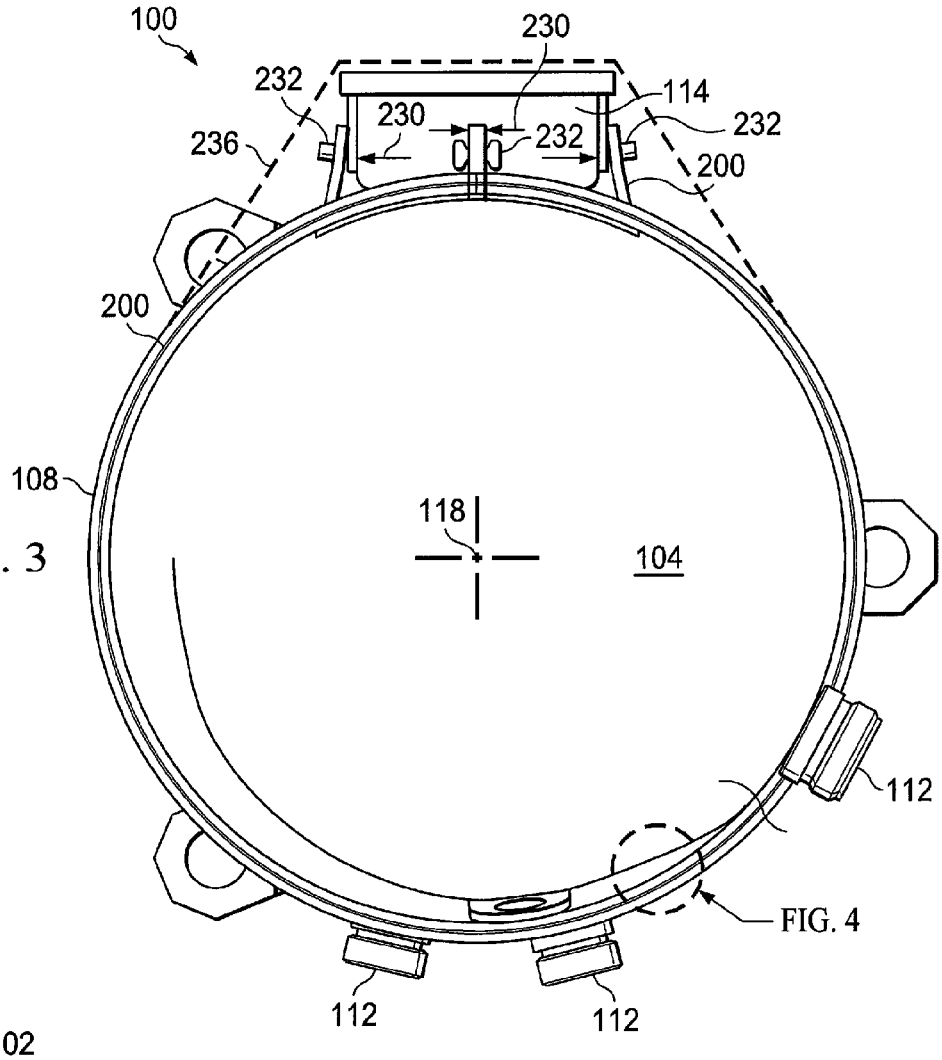
FIG. 3 is an orthogonal top view of the noise reduced compressor of FIG. 1.
Figure 4:
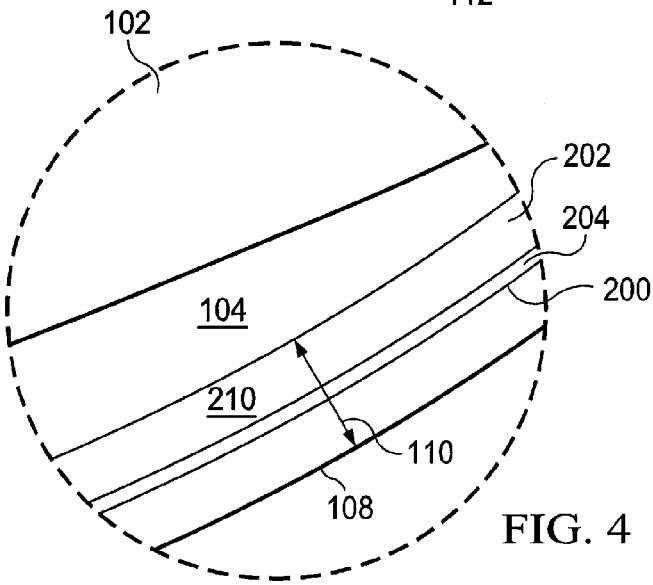
FIG. 4 is a detail view of a portion of FIG. 3, the portion showing a noise reducer applied near a hermetic joint of the noise reduced compressor of FIG. 1.
Figure 5:
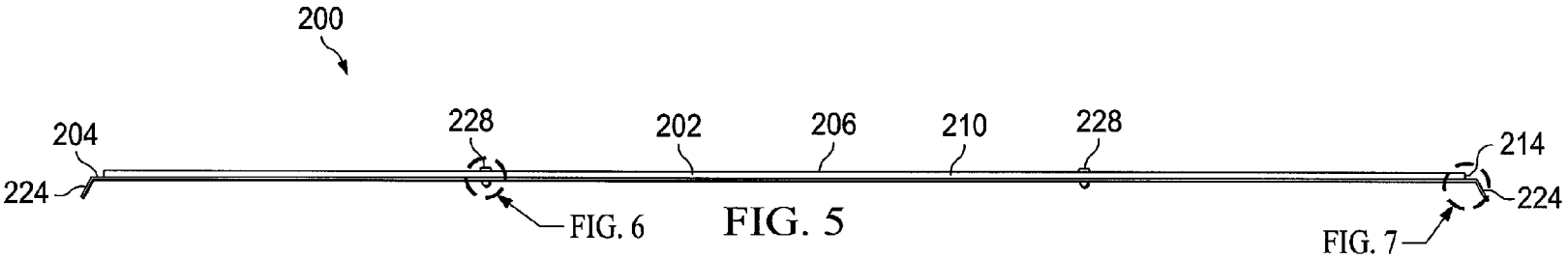
FIG. 5 is an orthogonal side view of a noise reducer according to an embodiment of the disclosure.
Figure 6:
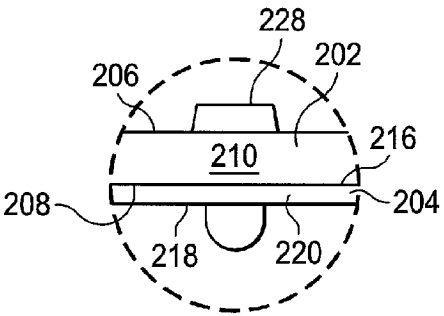
FIG. 6 is a detail view of a portion of FIG. 5, the portion generally showing an applied fastener of the noise reducer of FIG. 5.
Figure 7:
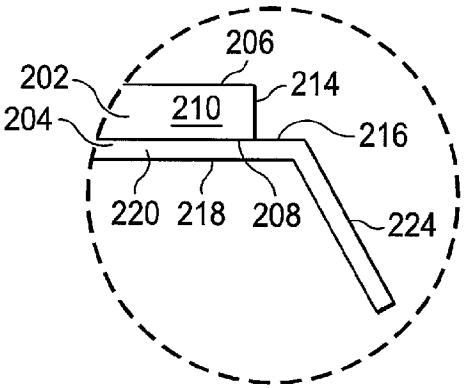
FIG. 7 is a detail view of a portion of FIG. 5, the portion generally showing an end portion of the noise reducer of FIG. 5.
Figure 8:
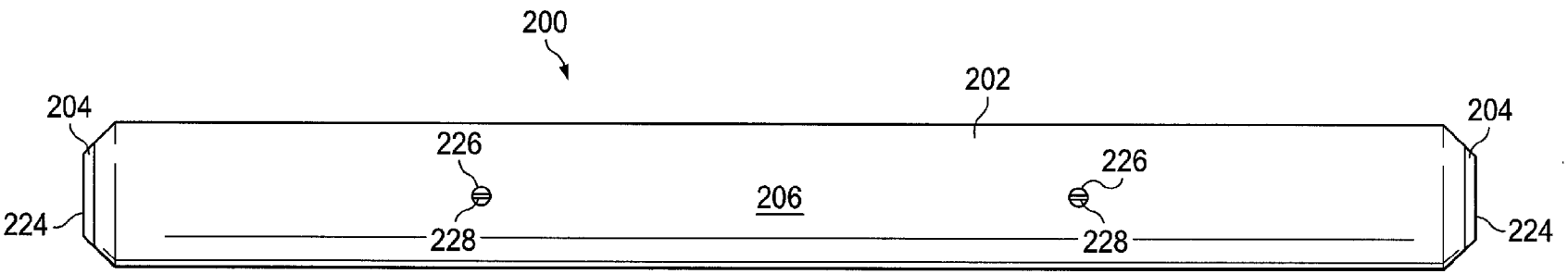
FIG. 8 is an orthogonal top view of the noise reducer of FIG. 5.
Figure 9:
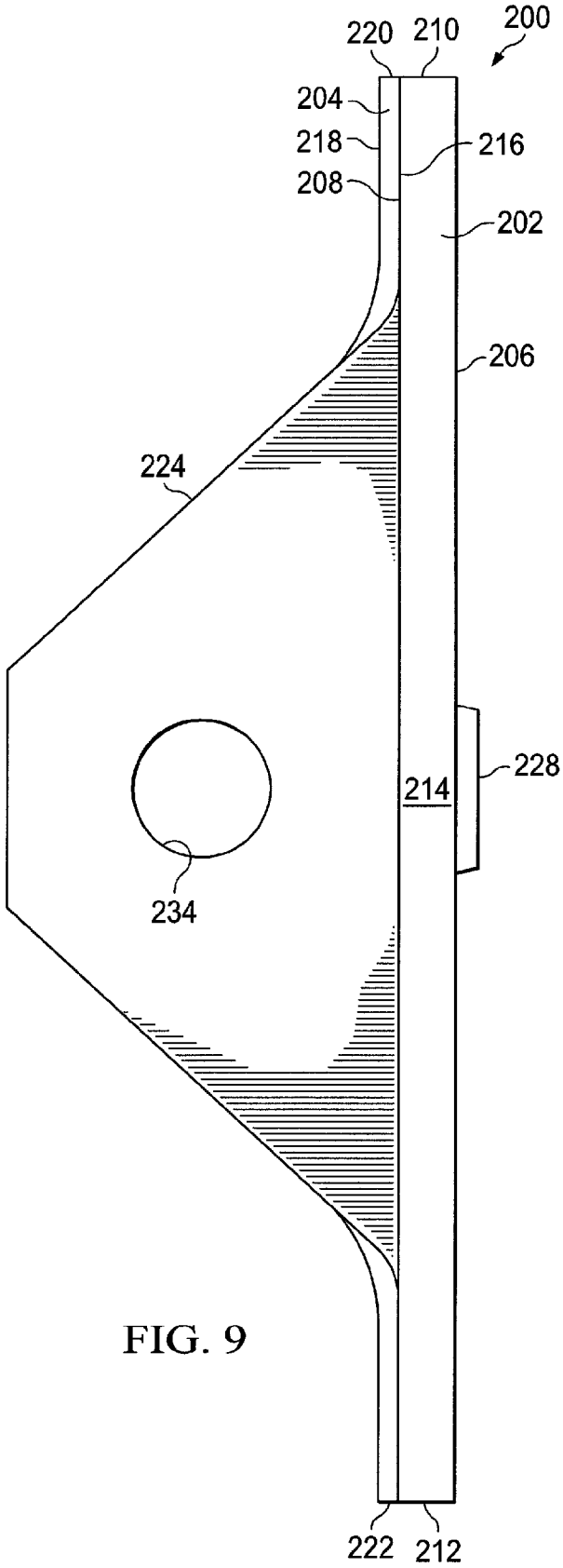
FIG. 9 is an orthogonal end view of the noise reducer of FIG. 5.

Further, FIG. 3 shows that the noise reducers 200 may be applied to the body 102 without increasing a dimensional footprint of the compressor 100. For example, a dimensional footprint 236 of the compressor 100 may be described generally as an envelope defining the overall dimension of the compressor 100 as viewed from above. The footprint 236 may comprise a portion of the circumference of the hermetic joint 108, two lines extending substantially tangentially from the circumference of the hermetic joint 108 to opposing sides of the outmost surfaces of the terminal box 114. As such, application of the noise reducers 200 in no way extend beyond the dimensional footprint 236 of the compressor 100, thereby providing the noise reduction benefits of the noise reducers without requiring a larger compressor footprint. In some embodiments, it may be advantageous to provide a noise reduced compressor 100 with a minimal footprint. For example, minimizing a noise reduced compressor 100 footprint may minimize instances of a compressor 100 and/or associated noise reduction components from impeding airflow and similarly impeding resultant heat exchange with a condenser coil and/or other heat exchangers of a condensing unit. Further, in some embodiments, an overall volume and/or dimensional footprint of a condensing unit may be minimized by minimizing the footprint of a noise reduced compressor 100.

In some embodiments, an overall length of the structural element 204 may be shorter than an outer circumferential path of the body 102 along which the noise reducer 200 is to be wrapped. In some embodiments, application of the noise reducer 200 to a body 102 may be complete when a sufficient force is applied and maintained which causes the tabs 224 to bend from a preinstallation orientation relative to the remainder of the structural element 204 and into an installation orientation where the tabs 224 are deformed and/or bent toward each other to become increasingly parallel and/or to increase contact with each other. In other embodiments, a bolt and/or other torque device may be applied in accordance with a predefined range of acceptable torque values known to resultantly press the EDE 202 against the body 102 with a desired force. With a noise reducer 200 connected to the body 102 as described above, vibratory energy produced by the compressor 100 may be transferred into the relatively viscoelastic EDE 202 where the energy performs mechanical work on the EDE 202 and ultimately transfers the vibratory energy to heat rather than noise. In other embodiments, the structural element 204 may comprise no tabs but may alternatively comprise features for interaction with features of the compressor 100 that, in combination, would similarly constrain the EDE 202 against the body 102 and result in a reduction in noise. In some embodiments, the above-described noise reducers 200 may provide a noise reduction of about 0.25 decibels to about 6 decibels, alternatively about 2 decibels to about 4 decibels, alternatively at least about 0.5 decibels.

Figure 10:
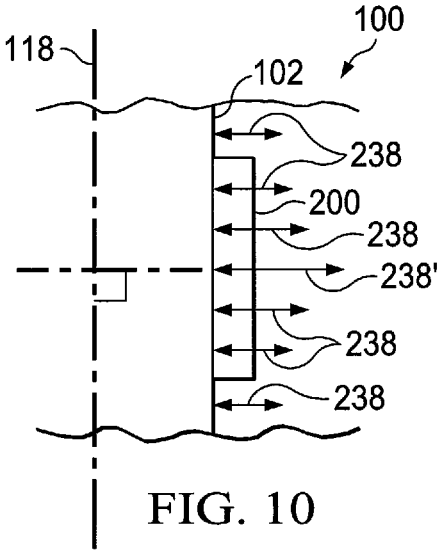
FIG. 10 is a simplified schematic showing a noise reduced compressor and a field of vibratory vectors.
Figure 11:
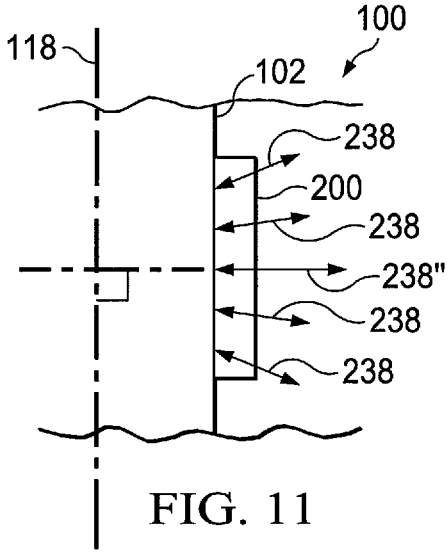
FIG. 11 is a simplified schematic showing a noise reduced compressor and another field of vibratory vectors.
Figure 12:
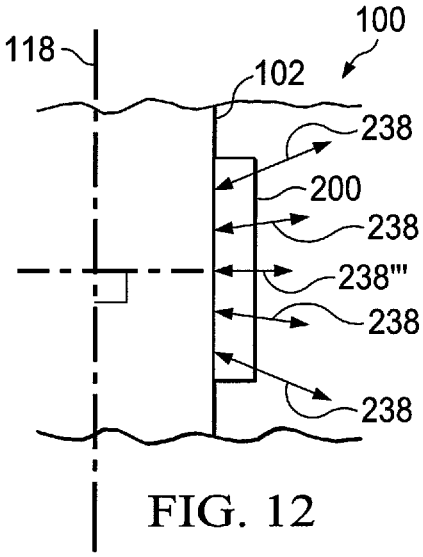
FIG. 12 is a simplified schematic showing a noise reduced compressor and yet another field of vibratory vectors.

Referring now to FIG. 10-12, simplified schematic views of an applied noise reducer 200 to a compressor 100 are shown. Further, each of FIGS. 10-12 shows different embodiments of vibratory vectors 238 and demonstrates that the noise reducer 200 may be selectively applied to reduce noise by considering the spatial orientation and magnitude of the vibratory vectors 238. With reference to FIG. 10, the vibratory vectors 238 each substantially alternate between being directed substantially outward and normal to the outer surface of the body 102 and being directed substantially inward toward axis 118. FIG. 10 also shows that a field of vibratory vectors 238 may comprise substantially constant directional orientation but may also comprise varying magnitudes. In this embodiment, the noise reducer 200 may be vertically centered and/or aligned with a maximum amplitude vibratory vector 238', and the noise reducer 200 may not counteract all of the vibratory vectors 238, such as the lower amplitude vibratory vectors 238 of FIG. 10 disposed further from the maximum amplitude vibratory vector 238'. In this embodiment, magnitudes of the vibratory vectors 238 decrease as vertical distance between the individual vibratory vectors 238 and the maximum amplitude vibratory vector 238' increases.

Referring now to FIG. 11, the vibratory vectors 238 each substantially alternate between being directed substantially at least partially outward from the outer surface of the body 102 and being directed at least partially inward toward axis 118. FIG. 11 shows that a field of vibratory vectors 238 may comprise substantially various directional orientations as well as comprising varying magnitudes. In this embodiment, the noise reducer 200 may be vertically centered and/or aligned with a maximum amplitude vibratory vector 238". In this embodiment, magnitudes of the vibratory vectors 238 decrease and a variance from being oriented substantially normal to the body 102 increases as vertical distance between the individual vibratory vectors 238 and the maximum amplitude vibratory vector 238" increases.

Referring now to FIG. 12, the vibratory vectors 238 each substantially alternate between being directed substantially at least partially outward from the outer surface of the body 102 and being directed at least partially inward toward axis 118. FIG. 12 also shows that a field of vibratory vectors 238 may comprise substantially various directional orientations as well as comprising varying magnitudes. In this embodiment, the noise reducer 200 may be vertically centered and/or aligned with a minimum amplitude vibratory vector 238''' and extend to counteract the maximum amplitude vectors 238 disposed furthest from the minimum amplitude vectors 238'''. In this embodiment, magnitudes of the vibratory vectors 238 increase and a variance from being oriented substantially normal to the body 102 increases as vertical distance between the individual vibratory vectors 238 and the minimum amplitude vibratory vector 238''' increases. This embodiment demonstrates that, in some embodiments, a noise reducer 200 may be vertically centered and/or aligned with a vibratory vector 238 other than a vibratory vector 238 having a maximum amplitude amongst a group of vibratory vectors 238 of a field of vibratory vectors 238. Collectively, FIGS. 10-12 illustrate that a noise reducer 200 may be applied to a compressor 100 in various orientations relative to a variety of fields of vibratory vectors 238 while still yielding a reduction in noise. Of course, in some embodiments, analysis of a field of vibratory vectors 238 may be performed prior to determining and/or applying a noise reducer 200 to a body 102. However, it will nonetheless be appreciated that noise reducers 200 may be applied to a body 102 so that noise reduction obtained is maximized, less than maximized, and/or is substantially less than maximized.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: $R=RI+k*(Ru-RI)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A noise reduced compressor, comprising:

a body;

an energy dissipation element configured as a lengthwise band extending substantially circumferentially around the body; and a structural element configured as a lengthwise band extending substantially circumferentially around the energy dissipation element and configured to compress the energy dissipation element and press the energy dissipation element toward the body;

wherein the energy dissipation element is configured to support substantially none of the weight of the body, wherein the structural element comprises a maximum axial length less than a maximum axial length of the body, and wherein the structural element is entirely axially aligned with the body between opposing axial ends of the body.

2. The noise reduced compressor of claim 1, wherein at least one of the energy dissipation element and the structural element are at least partially carried by the compressor.

3. The noise reduced compressor of claim 1, wherein the energy dissipation element comprises rubber.

4. The noise reduced compressor of claim 1, wherein the energy dissipation element is at least partially sandwiched between the body and the structural element.

5. The noise reduced compressor of claim 1, the structural element further comprising:

end tabs configured to allow application of forces applied to the end tabs to increase a force with which the energy dissipation element is pressed toward the body.

6. The noise reduced compressor of claim 1, wherein at least one of the energy dissipation element and the structural element do not extend beyond an overall dimensional footprint of the compressor.

7. A noise reducer for an HVAC system compressor, comprising:

an energy dissipation element configured as a lengthwise band that extends to form an open loop about a loop center; and a structural element connected to the energy dissipation element the structural element being configured as a lengthwise band that extends circumferentially around the energy dissipation element in an open loop and is configured to bias the energy dissipation element toward the loop center in response to a shortening of an offset distance between ends of the structural element;

wherein the noise reducer is configured to support substantially none of the weight of the HVAC system compressor, wherein the structural element comprises a maximum axial length less than a maximum axial length of the body, and wherein the structural element is entirely axially aligned with the body between opposing axial ends of the body.

8. The noise reducer of claim 7, further comprising:

at least one fastener configured to retain a connection between the energy dissipation element and the structural element.

9. The noise reducer of claim 7, wherein the energy dissipation element comprises rubber.

10. The noise reducer of claim 7, wherein the structural element comprises a metal.

11. The noise reducer of claim 7, the structural element comprising:

at least one end tab.

12. The noise reducer of claim 7, wherein the structural element comprises a longitudinal length less than about a circumference of a compressor.

13. The noise reducer of claim 7, wherein the structural element is configured to selectively force the energy dissipation element against the compressor.

* * * * *